US010364784B2

(12) United States Patent
Kuylenstierna et al.

(10) Patent No.: US 10,364,784 B2
(45) Date of Patent: Jul. 30, 2019

(54) FUEL INJECTOR ARRANGEMENT

(71) Applicant: VOLVO TRUCK CORPORATION, Gothenburg (SE)

(72) Inventors: Claes Kuylenstierna, Mölnlycke (SE); Thomas Svanberg, Stora Höga (SE)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 15/118,105

(22) PCT Filed: Apr. 11, 2014

(86) PCT No.: PCT/EP2014/000969
§ 371 (c)(1),
(2) Date: Aug. 11, 2016

(87) PCT Pub. No.: WO2015/120867
PCT Pub. Date: Aug. 20, 2015

(65) Prior Publication Data

US 2017/0145973 A1 May 25, 2017

Related U.S. Application Data

(60) Provisional application No. 61/938,407, filed on Feb. 11, 2014.

(51) Int. Cl.
*F02M 61/14* (2006.01)

(52) U.S. Cl.
CPC ..... *F02M 61/14* (2013.01); *F02M 2200/858* (2013.01); *F02M 2200/9015* (2013.01)

(58) Field of Classification Search
CPC ..... F02M 61/14; F02M 2200/9015; F02M 2200/858

(Continued)

(56) References Cited

U.S. PATENT DOCUMENTS 6,026,774 A * 2/2000 Kajihara ..... F02F 11/00 123/184.21
6,223,727 B1 * 5/2001 Tahara ..... F02M 51/0671 123/470

(Continued)

FOREIGN PATENT DOCUMENTS

DE 102007011316 A1 9/2008
DE 102007035714 A1 2/2009

(Continued)

OTHER PUBLICATIONS

International Search Report (dated Sep. 25, 2014) for corresponding International App. PCT/EP2014/000969.

(Continued)

*Primary Examiner* — Joseph J Dallo
*Assistant Examiner* — Scott A Reinbold
(74) *Attorney, Agent, or Firm* — WRB-IP LLP

(57) ABSTRACT

A fuel injector arrangement for supplying fuel into a cylinder of an internal combustion engine. The fuel injector arrangement includes a fuel injector and a sealing ring which is arranged around the circumference of the fuel injector. The sealing ring is located between a fuel inlet and/or outlet of the fuel injector located nearest to an injector tip of the fuel injector and the injector tip, wherein the sealing ring has an asymmetrical cross section with a narrow end extending towards the injector tip and a wider end extending away from the injector tip. The wider end has a recess therein creating two legs with a space there between.

24 Claims, 3 Drawing Sheets

(58) Field of Classification Search
USPC ..... 123/294
See application file for complete search history.

(56) References Cited

U.S. PATENT DOCUMENTS

| | | | | |
|---|---|---|---|---|
| 2003/0057656 | A1* | 3/2003 | Gorman | F16J 15/3236 277/549 |
| 2003/0178784 | A1 | 9/2003 | Nakayama et al. | |
| 2006/0213488 | A1* | 9/2006 | Post | F02M 55/005 123/527 |
| 2008/0265520 | A1* | 10/2008 | Kurth | F02M 61/14 277/549 |
| 2009/0241650 | A1* | 10/2009 | Kondo | F02M 47/027 73/114.43 |

FOREIGN PATENT DOCUMENTS

| | | | |
|---|---|---|---|
| EP | 1983187 | A1 | 10/2008 |
| JP | H11013565 | | 1/1999 |
| JP | 2001041131 | | 2/2001 |
| JP | 2003003920 | | 1/2003 |
| JP | 2004108181 | A | 10/2008 |

OTHER PUBLICATIONS

WO2007058103A1 (Abstract) (May 24, 2007) Toyota Motor Corp.
Japanese Official Action (dated Jan. 9, 2018) for corresponding Japanese App. 2016-551312.

* cited by examiner

FUEL INJECTOR ARRANGEMENT

BACKGROUND AND SUMMARY

The invention relates to a fuel injector arrangement for supplying fuel into a cylinder of an internal combustion engine. The fuel injector arrangement is configured to be inserted into an opening in a housing part to form a part of a fuel injection system. Said fuel injector arrangement or said fuel injection system may be used in an internal combustion engine, such as a diesel engine, where said engine can be used in any vehicle; such as a truck, bus, construction equipment or stationary power units such as genset etc.

Fuel injectors are used to supply fuel into the cylinders of an internal combustion engine. According to one engine concept example, a fuel distribution channel (a fuel gallery) is arranged crosswise through a housing for feeding fuel to a plurality of fuel injectors. Each fuel injector comprises an internal fuel channel arrangement extending between an opening into the fuel gallery and an opening in an injector tip forming a spray tip. The injection timing may be controlled mechanically and/or electronically for example via a plunger in the fuel injector.

When fuel is injected into a combustion chamber of a cylinder, the combustion of said fuel results in a high gas pressure, which pressure exerts a force on the injector tip and all the way up to a contact area between the fuel injector and an injector sleeve and/or a housing part receiving the injector. The contact area between the fuel injector and the injector sleeve/housing part is established and maintained by the clamping force of an injector yoke which counteracts the force caused by the gas pressure.

Combustion gas seals for injectors have been proposed in US 2003/0178784 A, wherein said seal is attached in an attachment groove provided in the injector, which is to be mounted on a cylinder head of an engine, to seal an annular gap between the cylinder head and the injector. Said seal has an inner diameter which prior to compressive deformation is set to be smaller than an outer diameter of the attachment groove and an outer diameter prior to compressive deformation is set to be larger than an inner diameter of a seal abutment of the cylinder head. An entire end surface of the seal on a combustion gas side is arranged to be exposed to combustion gas. With such constitution, inner and outer diameter sides of the seal are brought into contact with an injector and a cylinder head, respectively, without any gap therebetween, and an entire end surface of the seal is exposed to the combustion gas, so that the seal is caused by pressure applied by the combustion gas to extend toward inner and outer diameter sides, and surface pressures are further increased. The seal is configured and arranged to achieve as good sealing effect as possible.

It is important to maintain a high contact pressure in the contact area between the fuel injector and a cylinder head/an injector sleeve to avoid major leakage of combustion gases past the contact area. Such leakage may result in a pressure building in a cavity between the contact area and the seal which in the end may result in a force reducing the sealing force. The reduced sealing force may result in a severe leakage, which in turn may lead to a contaminated fuel in the fuel gallery.

Even though there may be a high contact pressure at the contact area, micro leakage of the combustion gas may occur and these small micro leakages may in time build a high pressure in the cavity between, the contact area and the seal which may result in reduced sealing force and combustion gases in large amounts entering the fuel system. The combustion gases will carry a high amount of small particles with them and these will contaminate the fuel. Excessive contamination of diesel fuel can cause premature clogging of diesel fuel filters and/or premature wear of critical fuel injection system parts. In addition the combustion gas in the fuel can lead to rough running of the engine as well as engine start issues.

It is desirable to provide a fuel injector arrangement, which creates conditions for a controlled, small leakage of combustion gases passed a seal in order to avoid an uncontrolled pressure build-up of combustion gases on an injector tip side of the seal.

A fuel injector arrangement according to an aspect of the invention comprises a fuel injector and a sealing ring which is arranged around the circumference of the fuel injector. The sealing ring is located between a fuel inlet and/or outlet of the fuel injector located nearest to an injector tip of the fuel injector and the injector tip. Said sealing ring has an asymmetrical cross section with a narrow end extending towards the injector tip and a wider end extending away from the injector tip wherein the wider end edge has a recess therein creating two legs with a space there between.

Proper dimensioning and design of this type of seal creates conditions for a small or more specifically microscopic leakage in the direction from the injector tip to the fuel inlet/outlet. Thus, it secures relief of any pressure build-up on the injector tip side of the seal.

As already mentioned, the fuel gallery connects a plurality of fuel injectors. More specifically, the fuel gallery forms a channel, which connects the openings in the housing for the fuel injectors. A portion of the opening receiving the fuel injector, which portion forms a part of the fuel gallery, may have an enlarged diameter. The opening portion forming the fuel gallery preferably has an extension in an axial direction of the fuel injector which is substantially longer than an extension of said fuel inlet and/or outlet. Preferably, the fuel inlet and/or outlet is positioned within the fuel gallery.

The specific design of the sealing ring allows for a tight seal between the fuel injector and the housing surrounding it when the engine is running. When the engine is running the pressure in the fuel gallery can vary from between 0-40 bar, most often it lies around 5 bar. Once the engine is turned off the pressure in the fuel gallery will slowly diminish and return to 0 bar. In a cavity below the sealing ring, between the fuel injector and the housing, pressure will build up when the engine is running, this pressure will normally lie somewhere between 0-5 bar. Once the engine is turned off and the pressure in the fuel gallery diminishes, the pressure built up in the cavity during the running of the engine will exert a force onto the seal from below whereby the recess in the seal will allow a minute movement of the second leg of the sealing ring towards the first leg and thus a micro leakage is obtained which slowly releases the combustion gas from the cavity into the fuel gallery situated above the sealing ring. The micro leakage of combustion gases from the cavity into the fuel gallery is in the order of 0.001-0.05 ml/hour.

As the pressure in the cavity is released every time the engine is turned off, very low amounts of combustion gas will be released into the fuel on each occasion. These low amounts of combustion gas will not affect the quality of the fuel and thus problems such as rough running of the engine as well as engine start issues can be avoided.

In addition, the construction of the seal allows for a slow release of the combustion gas from the cavity into the fuel gallery which enables the seal to act as a barrier and thereby stop contaminant particles from entering the fuel gallery together with the combustion gas. Hence, the seal will also ensure that the stringent cleanliness requirements of the fuel system are fulfilled.

According to one embodiment the legs of the sealing ring extend in a diverging configuration in a direction from the narrow end towards the wider end. This configuration will allow the sealing ring to increase its flexibility and also allow the possibility of producing a wider seal if such is needed for the specific application. In addition it has also been found that the sealing ring will adjust in guiding the fuel injector when this is positioned into the housing thereby assisting correct placement of the fuel injector.

According to one embodiment a first leg of said legs comprises a substantially straight radially inner surface contacting a radially outer surface of the fuel injector. An advantage of the straight radially inner surface is that the contact between the sealing ring and the fuel injector is improved so that no leakage of combustion gases can occur on this side of the sealing ring.

According to one embodiment the first leg has an at least partly substantially straight extension direction between the narrow end and the wider end. By having a straight extension of the first leg this will allow the sealing ring to fit correctly into a groove on the outer surface of the fuel injector thereby ensuring a correct positioning of the sealing ring.

According to one embodiment a second leg of said legs comprises a free end configured for radial abutment against a radially inner surface of an injector housing part. When the injector is inserted into a housing, the free end will follow the inner surface of the injector housing. This free end will reduce the sensitivity of the size of the sealing ring in relation to the housing as said free end allows for a certain adjustment as it can adjust the width of the seal to follow the surface of the housing. This will also allow for a certain adaptation of the sealing ring to fill out irregularities on the surface of the housing if such are present.

According to one embodiment the second leg has an at least partly substantially straight extension direction between the narrow end and the wider end. This construction has the advantage that the force exerted by the pressure of the combustion gas will be distributed evenly along the width of the leg. An even distribution of the forces allows for an improved calculation of the force exerted on the sealing ring leg at each specific point and this in turn enables an optimization of the sealing ring construction when considering size and materials. In addition, as the force is distributed evenly along the leg of the sealing ring it is less likely to uncontrollably collapse which would be detrimental for maintaining the high quality standard of the fuel.

According to one embodiment a second leg of said two legs projects from a first end of a first leg of said legs at the narrow end. This embodiment has the advantage that the length of the second leg can be varied quite much, from quite short to very long, to adjust to the size of the gap between the fuel injector and the housing.

According to one embodiment the asymmetrical cross section of the sealing ring is in the shape of a V. This embodiment is considered particularly suitable as it is a stable construction allowing for easy production of the sealing ring while at the same time providing optimized stability and sealing properties.

According to one embodiment a second leg of said two legs projects from a position between a first end at the narrow end and a second end at the wider end of a first leg of said legs. A seal with this configuration is considered extra suitable if the gap between the fuel injector and the housing is very narrow as it can be construed not to build as much width while still remaining structurally stable and securing a strong seal between the fuel injector and the housing. Another advantage of this construction is that the pressure exerted onto the sealing ring from the fuel gallery which act on the second leg will have both a pulling force and a pushing force on the first leg which is in contact with the fuel injector and thereby friction is increased which reduces the occurrence of slipping of the sealing ring even if said sealing ring is not placed in a groove on the surface of the fuel injector.

According to one embodiment the sealing ring is in contact with the fuel injector along the complete height of the sealing ring, from the narrow end to the wide end. This embodiment secures a tight fit of the sealing ring around the fuel injector and thereby no leakage will occur in the contact area between the sealing ring and the fuel injector. In addition a large contact area between the sealing ring and the fuel injector will secure a high friction and thus slipping of the sealing ring is avoided even if the sealing ring is not placed in a groove on the fuel injector.

According to one embodiment the angle (a) between the legs of the sealing ring lies between 25 and 70 degrees. By choosing the angle between these intervals it can be secured that the seal performs optimally in that during running of the engine a tight seal is ensured and then when the engine is turned off a micro leakage occurs. In addition by altering the angle the size of the recess between the legs of the sealing ring can be optimized for the intended use.

According to one embodiment the sealing ring is made of an elastic material. A large advantage of elastic materials is that their retraction forces will ensure that a tight seal is achieved between the sealing ring and the fuel injector. Elastic materials are also flexible and will allow for the micro leakage to occur when the engine is turned off.

According to one embodiment the elastic material is chosen from synthetic rubber and thermoplastic elastomers. Synthetic rubber has the advantage that it is highly elastomeric and can undergo a very high elastic deformation and still return to its initial size. The synthetic rubber will thus allow for a sealing ring to be produced which provides a very strong attachment between the sealing ring and the fuel injector in that the elastic forces of the rubber will ensure an inwardly directed force toward the radial center of the fuel injector. Thermoplastic materials have the advantage that they are easy to mold and thus their use will facilitate production of the sealing ring. In addition they are recyclable which will allow the material to be reused when the sealing ring is replaced by a new sealing ring.

According to one embodiment the synthetic rubber is chosen from butadiene rubber, butyl rubber, chlorosulfonated polyethylene, epichlorohydrin, ethylene propylene rubber, fluoroelastomer, nitrile rubber, perfluoroelastomner, polyacrylate rubber, polychloroprene, polyisoprene, polysulfide rubber, polytertafluoroethylene, sanifluor and silicone rubber. These specific rubbers have the advantage of being suitable as material in a sealing ring while at the same time having such properties that the material quality is not compromised by the chemical environment caused by the fuel and combustion gases.

According to one embodiment the thermoplastic elastomer is chosen from thermoplastic elastomer styrenics, thermoplastic polyolefin, thermoplastic polyurethane, thermoplastic etheresterelastomers copolyesters, thermoplastic polyamide, melt processable rubber and thermoplastic vulcanite. These specific thermoplastic elastomers have the advantage of being suitable as material in a sealing ring while at the same time having such properties that the material quality is not compromised by the chemical environment caused by the fuel and combustion gases.

According to one embodiment the sealing ring has a height of 2 to 5 mm, and a width of 0.25 to 4 mm. The height is measured along the first leg from the narrow end of the sealing ring to the wider end of the sealing ring. The width is measured from the surface of the fuel injector to the extension of the second leg which is situated furthest from the surface of the fuel injector. These dimensions are chosen to provide an optimal size of the sealing ring to secure a tight seal between the fuel injector and the housing. If the seal is too bulky then it will be difficult to insert the fuel injector into the housing and if it is too small the sealing ring will not form a tight seal in the gap between the fuel injector and the housing.

The invention also relates to a fuel injection system for supplying fuel into a cylinder of an internal combustion engine, wherein the fuel injection system comprises a housing part with an opening configured for receiving a fuel injector arrangement wherein a fuel injector arrangement is positioned in the opening. When the fuel injector arrangement is inserted into the housing, the sealing ring will provide the benefit of providing a tight seal during running of the engine and then once the engine is turned off the micro leakage will occur thereby removing the pressure built up below the sealing ring in the cavity between the fuel injector and housing. This embodiment will thus ensure that large volumes of combustion gas and particles do not enter the fuel which will ensure a smooth running of the engine and customer complaints due to rough running of the engine as well as engine start issues can be avoided.

According to one embodiment the opening comprises a widened portion forming a fuel gallery around the fuel injector and that a first sealing ring of said sealing rings is positioned around the fuel injector between the fuel gallery and the injector tip. By placing the sealing ring between the fuel gallery and the injector tip of the fuel injector the optimum performance of the improved sealing system provided by the sealing ring is obtained.

The invention also relates to an internal combustion engine comprising a fuel injector arrangement or a fuel injector system as described above. An engine comprising the above described fuel injector arrangement or fuel injector system will ensure a smooth running of the engine. This will have the advantage not only of fewer customer complaints but also that the wear and tear of the fuel injector, filters and other parts of the engine is reduced as the fuel is not polluted by particles and combustion gases. In addition the combustion engine will probably require less maintenance as the parts of the engine will not clog due to unclean fuel.

The invention also relates to a vehicle comprising an internal combustion engine as described above. As described above the internal combustion engine will greatly profit from the fuel injector assembly or the fuel injector system as it will increase the lifetime of said engine and also reduce the maintenance thereof. This advantage will also be present in vehicles comprising an internal combustion engine as disclosed above.

By the term "fuel inlet and/or outlet" is meant an opening in the fuel injector which allows fuel to either enter into the fuel injector, or it allows fuel to exit from the fuel injector and in some cases the opening can have a dual function in that it allows fluid to both enter into the fuel injector and to exit the fuel injector therethrough.

BRIEF DESCRIPTION OF THE DRAWINGS

With reference to the appended drawings, below follows a more detailed description of example embodiments of the invention.

DETAILED DESCRIPTION

The present invention will now be described more fully hereinafter with reference to the accompanying drawings, in which different embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
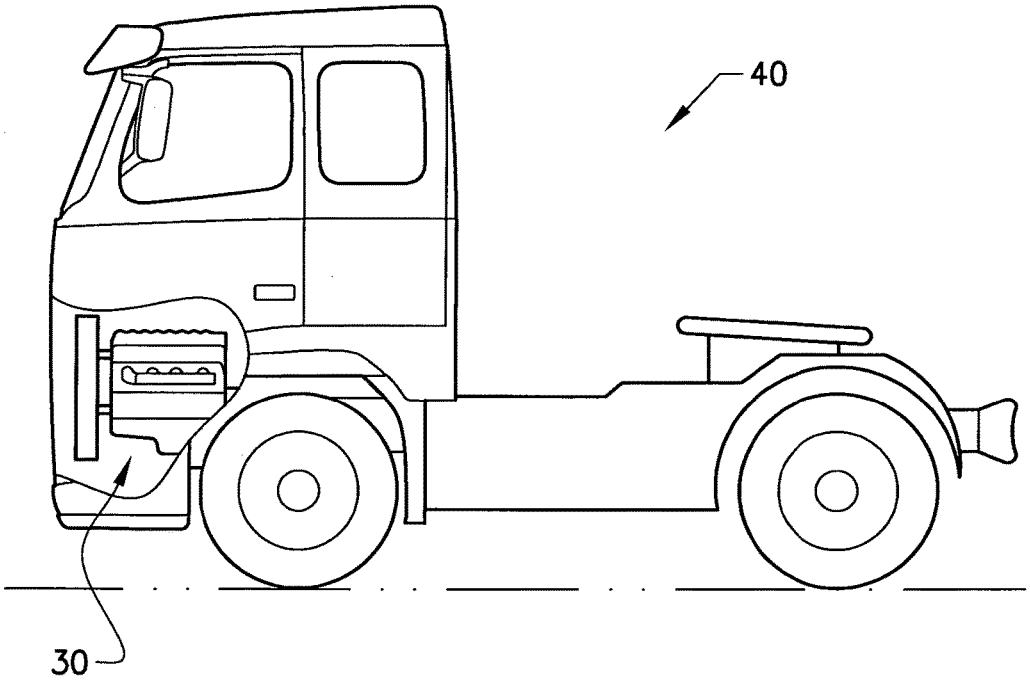
FIG. 1 shows a vehicle comprising an internal combustion engine.
Figure 2:
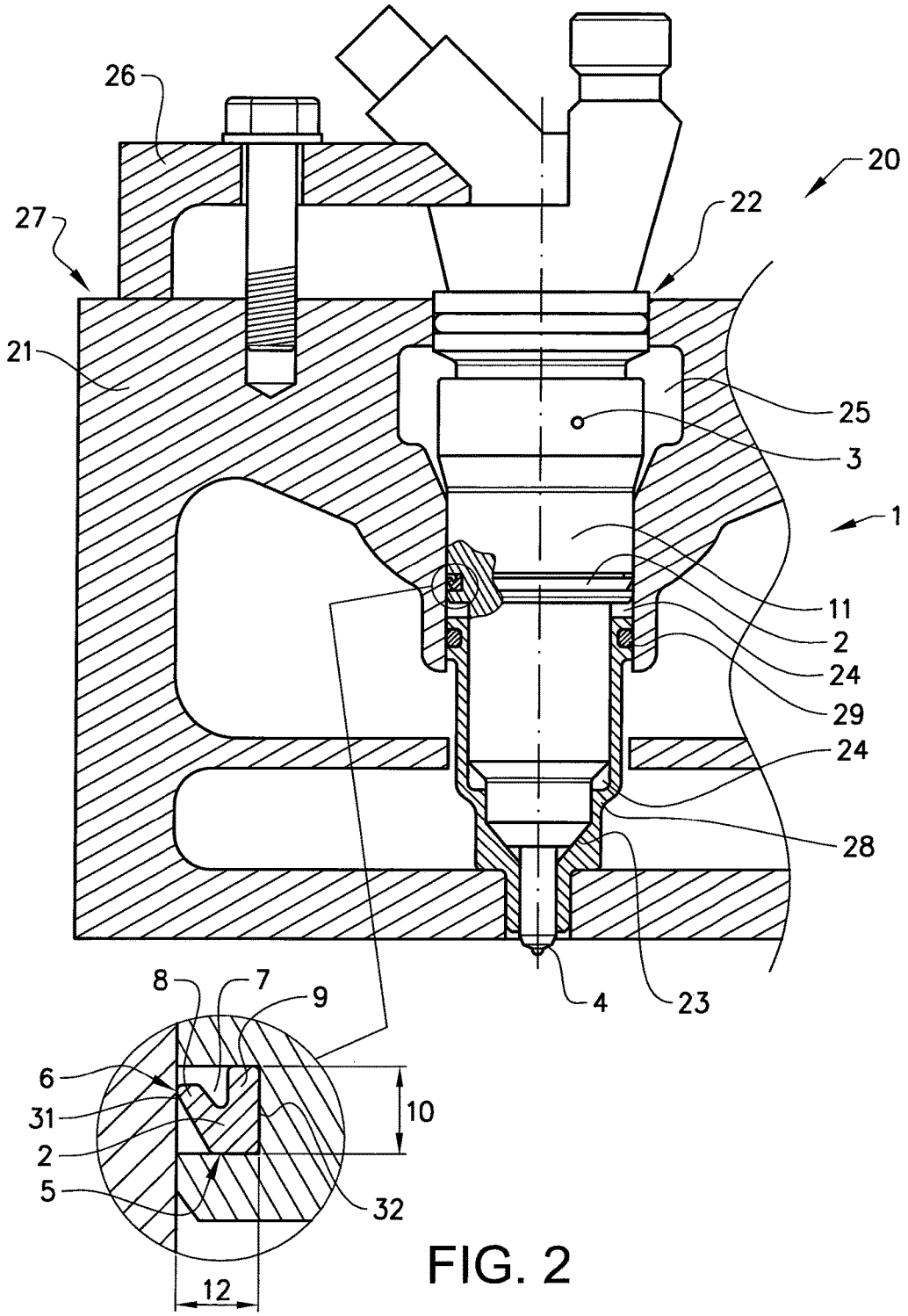
FIG. 2 illustrates a fuel injection system according to a first embodiment, in a cross sectional side view, wherein said system comprises a fuel injector arrangement according to a first embodiment and a sealing ring according to a first embodiment.

FIG. 1 shows a vehicle 40 in the form of a truck, which comprises an internal combustion engine 30, in the form of a diesel engine for propelling the truck. The internal combustion engine 30 comprises a fuel injector system 20, which is shown in FIG. 2. The fuel injector system 20 in turn comprises a fuel injector arrangement 1, which is also shown in FIG. 2.

In FIG. 2, the fuel injector arrangement 1 is shown according to a first embodiment. The fuel injector arrangement 1 comprises a fuel injector 11 and a sealing ring 2 according to a first embodiment. The fuel injector 11 is elongated and comprises an injector casing and an internal fuel system for delivery of fuel to its spray tip 4. The sealing ring 2 is arranged around the circumference of the fuel injector 11, and more specifically in a groove in the injector casing. The sealing ring is located between a fuel inlet and/or outlet 3 of the fuel injector located nearest to the injector tip 4 and the injector tip 4 of the fuel injector. The sealing ring 2 has an asymmetrical cross section with a narrow end 5 extending towards the injector tip 4 of the fuel injector 11 and a wider end 6 extending away from the injector tip 4. In the wider end edge 6 a recess 7 is present thereby creating two legs 8, 9 with a space there between.

The groove has dimensions which substantially correspond to a height and a width of the sealing ring 2. More specifically, the groove has parallel upper and lower inner surfaces.

In FIG. 2, the fuel injector 11 is depicted with only one fuel inlet and/or outlet 3. It is also known that fuel injectors 11 may comprise more than one fuel inlet and/or outlet 3 each of which may have the same function or they can have different functions. For such fuel injectors 11, it is possible to use more than one sealing ring 2 between each of the fuel inlet and/or outlet 3 as long as the sealing ring 2 situated closest to the injector tip 4 is a sealing ring 2 as described herein.

The fuel injection system 20 comprises a housing part 21 with an elongated opening 22 configured for receiving the fuel injector arrangement 1. The fuel injector arrangement 1 is positioned in the opening 22. The fuel injection system 20 is configured and arranged to supply fuel into at least one cylinder of the internal combustion engine 30. When the fuel injector arrangement 1 is positioned in the opening 22 in the housing part 21, the sealing ring 2 is configured to provide a sealing of the gap between the fuel injector 11 and the housing part 21.

A fuel gallery 25 is present in communication with the fuel inlet and/or outlet 3 of the fuel injector 11. More specifically, the fuel inlet and/or outlet 3 of the fuel injector 11 ends in the fuel gallery 25. The fuel gallery 25 forms a fuel channel extending in a crosswise direction in relation to an axial direction of the fuel injector 11 and is preferably configured for distributing fuel to a plurality of the fuel injectors of the engine. The sealing ring 2 is positioned between the fuel gallery 25 and the injector tip 4.

Below the sealing ring 2 in the direction of the fuel injector tip 4, a cavity 24 is formed between the fuel injector 11 and the housing 21. More specifically, a portion of the opening 22 is formed with a wider diameter than an outer diameter of a corresponding part of the injector, which portion forms the cavity.

In the specific embodiment illustrated, an injector sleeve 28 is used in combination with the housing part 21 to hold the fuel injector 11. The sleeve 28 receives a portion of the fuel injector 11 in the vicinity of the injector tip 4. The housing part 21 is provided with cooling channels around the sleeve 28 for cooling thereof. The injector sleeve 28 is placed in the opening 22 of the housing part 21 and a seal 29 is used to provide a tight fit between the housing part 21 and the injector sleeve 28. The seal 29 is positioned in a groove in the sleeve 28 and can be any standard type of seal used for sealing as long as it is compatible with fuel and combustion gases, examples of seals may be an o-ring, a metal seal, a polymeric seal, an elastic seal or combinations thereof. The injector sleeve 28 and the housing part 21 assist in holding and aligning the fuel injector 11 into a correct position. The fuel injector 11 is in direct contact with the injector sleeve 28 at a contact area 23. The contact force in the contact area 23 is assisted by a yoke 26 at an opposite side of the injector in relation to the injector tip 4. The yoke 26 is configured to push the fuel injector 1 towards the housing part 21 and injector sleeve 28 to secure a tight seal in the contact area 23.

In FIG. 2, a cylinder head 27 is depicted with the housing part 21 in combination with the injector sleeve 28. It is also known to have a housing part without an injector sleeve 28, where the housing part extends along the side of the fuel injector 11 all the way from the top of the housing part near the yoke 26 to the fuel injector tip 4. The housing part of the cylinder head 27 will then form a contact area 23 with the fuel injector 11.

Turning now to the design of the seal 2. The legs 8, 9 extend in a diverging configuration in a direction from the narrow end 5 towards the wider end 6. The first leg 9 has a substantially straight radially inner surface 32 contacting a straight radially outer surface of the fuel injector 11 within the groove. In other words, the groove is configured so that the inner surface extends in an axial direction of the injector 11. FIG. 2 shows the seal 2 in a state applied around the injector 11, wherein the complete radially inner surface 32 of the fuel injector 11 contacts the radially outer surface of the fuel injector 11 within the groove.

The first leg 9 has an at least partly substantially straight extension direction between the narrow end 5 and the wider end 6 of the sealing ring 2. More specifically, the first leg 9 has a straight extension direction between the narrow end 5 and the wider end. 6 of the sealing ring 2.

The second leg 8 comprises a free end 31 configured for radial abutment against a radially inner surface of the injector housing part 21. The second leg 8 has an extension direction at an angle in relation to the radially inner surface of the opening 22 of the injector housing part 21. The second leg 8 has an extension direction at an angle in relation to the axial direction of the fuel injector 11. The free end 31 of the second leg 8 will by means of this configuration contact the radially inner surface of the opening 22 along a relatively short axial distance. More specifically, the contact surface of the second leg 8 to the radially inner surface of the opening 22 is much smaller than the contact surface of the first leg 9 to the inner surface of the groove. Further, the second leg 8 has such an extension that its free end 31 is positioned at an axial distance from an upper limitation surface of the groove. More specifically, the free end 31 is positioned closer to an upper limitation surface of the groove than a lower limitation surface of the groove in the axial direction of the fuel injector 11.

The second leg 8 has an at least partly substantially straight extension direction between the narrow end 5 and the wider end 6. The second leg 8 projects from a first end of a first leg 9 of said legs at the narrow end 5. The asymmetrical cross section of the sealing ring 2 is in the basic shape of a V. Further, a lower part of the seal 2 facing towards the injector tip 4 is not acute like in a proper V-shape, but rather flat and abuts a lower surface of the groove along a substantial portion thereof. More specifically, the seal 2 is configured so that it extends along the lower surface of the groove along at least half its radial extension.

The sealing ring has a height 10 and a width 12. The sealing ring 2 is in contact with the fuel injector 1 along the complete height 10 of the sealing ring 2, from the narrow end 5 to the wide end 6.

The sealing ring 2 can be prepared using any type of a wide range of materials considered suitable for use in an environment with fuel and combustion gas. The material used should allow for some flexibility as it will need to allow the combustion gas caught in the cavity 24 between the fuel injector arrangement 1 and the housing 21 to slowly seep past the sealing ring 2 as a micro leakage, as the pressure drops in the fuel gallery 25. An example of a material having some flexibility would be an elastic material, however the skilled worker could envisage a number of such materials such as: a metal sealing ring 2 which has a thin second leg 8 thus allowing for flexibility in this second leg 8, a polymer material which is not considered elastic but nevertheless has some flexible properties, or combinations of these material types.

Figure 3:
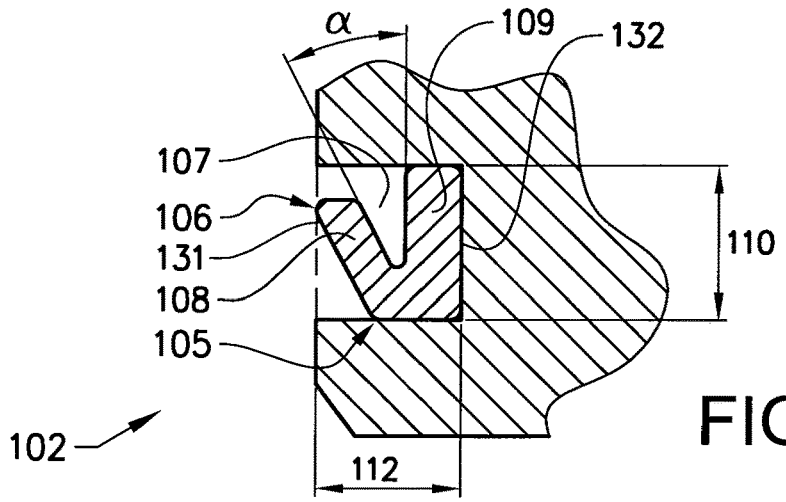
FIGS. 3-5 shows the sealing ring according to a second, third and fourth embodiment.

In FIG. 3, a sealing ring 102 is shown according to a second embodiment where the sealing ring 102 has an asymmetrical cross section with a narrow end 105 extending towards an injector tip 4 of the fuel injector 11 and a wider end 106 extending away from the injector tip 4. In the wider end 106 a recess 107 is present thereby creating two legs 108,109 with a space there between. The depth of the recess 107 can be varied depending on the material used. This can be used to optimize the sealing ring 102 in order to ensure a structure which is rigid enough to withstand the forces acting on the sealing ring 102 and yet still has some flexibility to allow for the micro leakage.

The legs 108,109 extend in a diverging configuration in a direction from the narrow end 105 towards the wider end 106. The first leg 109 has a substantially straight radially inner surface 132 contacting a radially outer surface of the fuel injector 11. The first leg 109 has an at least partly substantially straight extension direction between the narrow end 105 and the wider end 106 of the sealing ring 102.

The second leg 108 comprises a free end 131 configured for radial abutment against a radially inner surface of an injector housing part. The second leg 8 has an at least partly substantially straight extension direction between the narrow end 5 and the wider end 6. The second leg 8 of said two legs projects from a first end of a first leg 9 of said legs at the narrow end 5. The asymmetrical cross section of the sealing ring 2 is in the shape of a V.

The sealing ring has a height 110 and a width 112. The sealing ring 102 is in contact with the fuel injector 1 along the complete height 110 of the sealing ring. 102, from the narrow end 105 to the wide end 106. Between the legs 108,109 of the sealing ring 102 an angle a is formed.

Figure 4:
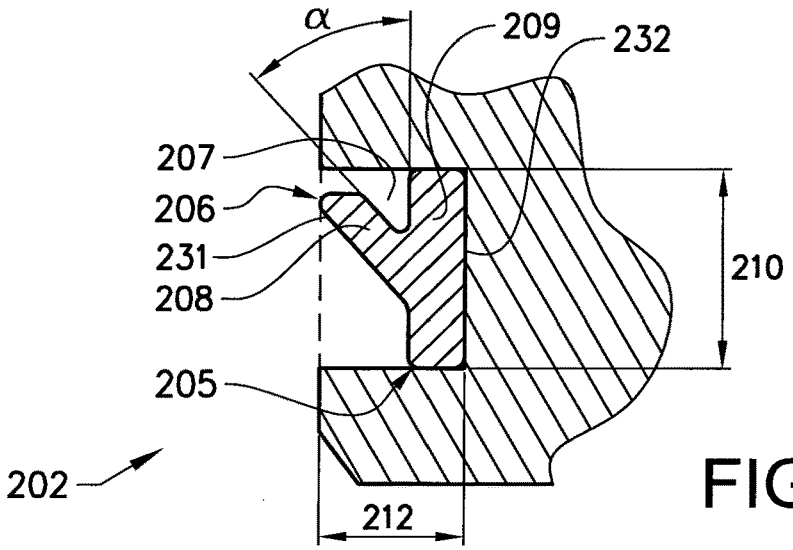

In FIG. 4, a sealing ring 202 is shown according to a third embodiment where the sealing ring 202 has an asymmetrical cross section with a narrow end 205 extending towards an injector tip 4 of the fuel injector 11 and a wider end 206 extending away from the injector tip 4. In the wider end edge 206 a recess 207 is present thereby creating two legs 208,209 with a space there between.

The legs 208,209 extend in a diverging configuration in a direction from the narrow end 205 towards the wider end 206. The first leg 209 has a substantially straight radially inner surface 232 contacting a radially outer surface of the fuel injector 1. The first leg 209 has an at least partly substantially straight extension direction between the narrow end 205 and the wider end 206 of the sealing ring 202.

The second leg 208 comprises a free end 231 configured for radial abutment against a radially inner surface of an injector housing part. The second leg 208 has an at least partly substantially straight extension direction between the narrow end 205 and the wider end 206. The second leg 208 projects from a position between a first end at the narrow end 205 and a second end at the wider end 206 of a first leg 209 of said legs. More specifically, the second leg 208 projects from a position about midway between a first end at the narrow end 205 and a second end at the wider end 206 of a first leg 209.

The sealing ring 202 has a height 210 and a width 212. The sealing ring 202 is in contact with the fuel injector 1 along the complete height 210 of the sealing ring 202, from the narrow end 205 to the wide end 206. Between the legs 208,209 of the sealing ring 202 an angle a is formed.

Figure 5:
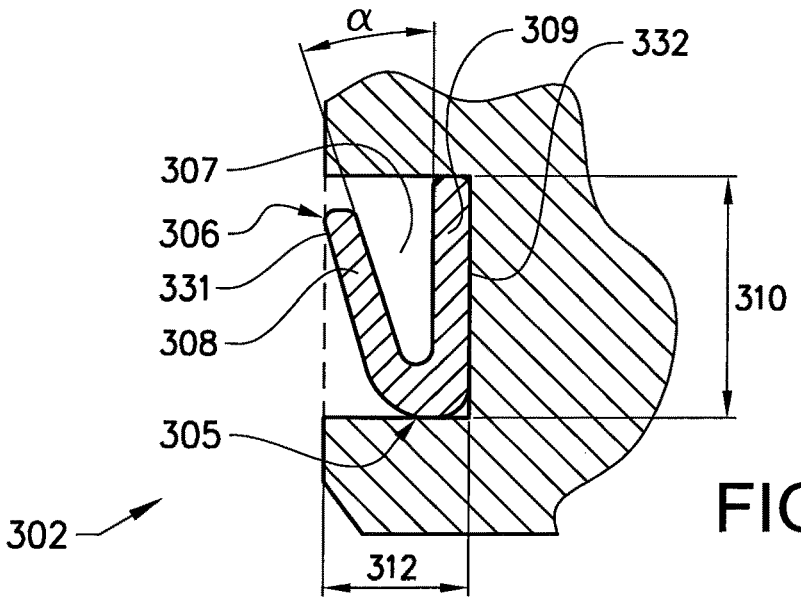

In FIG. 5, a sealing ring 302 is shown according to a fourth embodiment where the sealing ring 302 has an asymmetrical cross section with, a narrow end 305 extending towards an injector tip 4 of the fuel injector 1 and a wider end 306 extending away from the injector tip 4. In the wider end edge 306 a recess 307 is present thereby creating two legs 308,309 with a space there between.

The legs 308,309 extend in a diverging configuration in a direction from the narrow end 305 towards the wider end 306. The first leg 309 has a substantially straight radially inner surface 332 contacting a radially outer surface of the fuel injector 11. The first leg 309 has an at least partly substantially straight extension direction between the narrow end 305 and the wider end 306 of the sealing ring 2.

The second leg 308 comprises a free end 331 configured for radial abutment against a radially inner surface of an injector housing part. The second leg 308 projects from a first end of a first leg 309 of said legs at the narrow end 305. The legs 8,9 are joined in a slightly curved region.

The sealing ring has a height 310 and a width 312. Between the legs 308,309 of the sealing ring 302 an angle a is formed.

Additionally, variations to the disclosed example embodiments can be understood and effected by the skilled person in practicing the claimed invention, from study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to claim advantages.

The invention claimed is:

1. A fuel injector arrangement for supplying fuel into a cylinder of an internal combustion engine, the fuel injector arrangement comprising a fuel injector and a sealing ring which is arranged around the circumference of the fuel injector, the sealing ring being located between at least or one of:

a fuel inlet of the fuel injector located nearest to an injector up of the fuel injector and the injector tip, and an outlet of the fuel injector located nearest to an injector tip of the fuel injector and the injector tip, wherein the fuel injector arrangement is adapted to be positioned in art opening of a housing part so that a gap is formed between a portion of the fuel injector around which the sealing ring is arranged and the housing part, and wherein the sealing ring has an asymmetrical cross section with a narrow end extending towards the injector tip and a wider end extending away from the injector tip wherein the wider end has a recess therein creating two legs with a space therebetween, such that an outer leg of the two legs is moveable from an abutment position, the outer leg of the two legs abutting the housing in the abutment position to seal the gap when the fuel injector arrangement is positioned in the opening in, the housing part, towards an inner leg of the two legs.

2. A fuel injector arrangement according to claim 1, wherein the legs extend in a diverging configuration in a direction from the narrow end towards the wider end.

3. A fuel injector arrangement according to claim 1, wherein a first leg of the legs comprises a substantially straight radially inner surface contacting a radially outer surface of the fuel injector.

4. A fuel injector arrangement according to claim 1, wherein a first leg of the legs has an at, least partly straight extension direction between the narrow end and the wider end.

5. A fuel injector arrangement according to claim 1, Wherein a second leg of the legs comprises a free end configured for radial abutment against a radially inner surface of art injector housing part.

6. A fuel injector arrangement according to claim 1, wherein the second leg of the legs has an at least partly straight extension direction between the narrow end and the wider end.

7. A fuel injector arrangement according to claim 1, Wherein a second leg of the two legs projects from a first end of a first leg of the legs at the narrow end.

8. A fuel injector arrangement according to claim 1, wherein the asymmetrical cross section of the sealing ring is in the shape of a V.

9. A fuel injector arrangement according to claim 1, wherein a second leg of the two legs projects from a position between a first end at the narrow end and a second end at the wider end of a first leg of the legs.

10. A fuel injector arrangement according to claim 1, wherein the sealing ring is in contact with the fuel injector along the complete height of the sealing ring, from the narrow end to the wide end.

11. A fuel injector arrangement according to claim 1, wherein the angle between the legs of the sealing ring lies between 25 and 70 degrees.

12. A fuel injector arrangement according to claim 1, wherein the sealing ring is made of an elastic material.

13. A fuel injector arrangement according to claim 12, wherein the elastic material is chosen from synthetic rubber and thermoplastic elastomers.

14. A fuel injector arrangement according to claim 13, wherein the synthetic rubber is chosen from butadiene rubber, butyl rubber, chlorosulfonated polyethylene, epichlorohydrin, ethylene propylene rubber, fluoroelastomer, nitrile rubber, perfluoroelastoiner, polyacrylate rubber, polychloroprene, polyisoprene, polysulfide rubber, polytertafluoroethylene, sanifluor and silicone rubber.

15. A fuel injector arrangement according to claim 13 wherein the thermoplastic elastomer is chosen from thermoplastic elastomer styrenics, thermoplastic polyolefin, thermoplastic polyurethane, thermoplastic etheresterelastomers copolyesters, thermoplastic polyamide, melt processible rubber and thermoplastic vulcanite.

16. A fuel injector arrangement according to claim 1, wherein the sealing ring has a height of 2 to 5 mm, and a width of 0.25 to 4 mm.

17. A fuel injection system for supplying fuel into a cylinder of an internal combustion engine, wherein the fuel injection system comprises a housing part with an opening configured for receiving a fuel injector arrangement wherein the fuel, injector arrangement according to claim 1 is positioned in the opening.

18. A fuel injection system according to claim 17, wherein the opening comprises a widened portion forming a part of a fuel gallery around the fuel injector and that the sealing ring is positioned around the fuel injector between the fuel gallery and the injector tip.

19. A fuel injection system according to claim 17, comprising a sleeve which receives a portion of the fuel injector in the vicinity of the injector tip and wherein the sleeve is arranged in the opening.

20. An internal combustion engine comprising a fuel injector arrangement according to claim 1.

21. A vehicle comprising an internal combustion engine according to claim 20.

22. A fuel injector arrangement according to claim 1, wherein a surface of the sealing ring defining the recess faces away from the injector tip.

23. A fuel injector arrangement according to claim 1, wherein the fuel injector arrangement is adapted to be positioned in an opening of a housing part so that a gap is formed between a portion of the fuel injector around which the sealing ring is arranged and the housing part and, when the fuel injector arrangement is positioned in the opening in the housing part, the sealing ring seals, the gap between the fuel injector and the housing pact.

24. A fuel injection system according to claim 17, wherein the fuel injector arrangement is positioned in the opening, of a housing part so that a gap is formed between a portion of the fuel injector around which the sealing ring is arranged and the housing part and, when the fuel injector arrangement is positioned in the opening in the housing part, the sealing ring seals the gap between the fuel injector and the housing part.

* * * * *